US005486055A

United States Patent [19]

Oka

[11] Patent Number: 5,486,055

[45] Date of Patent: Jan. 23, 1996

[54] OUTPUT METHOD AND APPARATUS

[75] Inventor: Hirotsugu Oka, Tokyo, Japan

[73] Assignee: Canon Kabushiki Kaisha, Tokyo, Japan

[21] Appl. No.: 223,126

[22] Filed: Apr. 5, 1994

Related U.S. Application Data

[63] Continuation of Ser. No. 685,640, Apr. 16, 1991, abandoned.

[30] Foreign Application Priority Data

Apr. 20, 1990 [JP] Japan ..... 2-105622

[51] Int. Cl.[6] ..... B41J 5/00

[52] U.S. Cl. ..... 400/61; 400/279; 400/274

[58] Field of Search ..... 400/61, 62, 63, 400/64, 68, 83, 274, 322, 279, 703; 364/519; 318/685

[56] References Cited

U.S. PATENT DOCUMENTS

| | | | |
|---|---|---|---|
| 4,311,399 | 1/1982 | Wegryn et al. | 400/279 |
| 4,651,278 | 3/1987 | Herzog et al. | 400/61 |
| 4,669,900 | 6/1987 | Miyake et al. | 400/903 |
| 4,718,784 | 1/1988 | Drisko | 400/68 |
| 4,832,513 | 5/1989 | Ikekita | 400/61 |
| 4,875,774 | 10/1989 | Olodorf et al. | 400/83 |
| 4,897,589 | 1/1990 | Fujiwara et al. | 318/685 |
| 4,974,978 | 12/1990 | Tsukamoto | 400/279 |
| 4,988,221 | 6/1991 | Shibayama et al. | 400/61 |
| 5,007,751 | 4/1991 | Yamakawa | 400/279 |
| 5,033,879 | 7/1991 | Abe et al. | 400/61 |
| 5,055,835 | 10/1991 | Takahashi | 400/279 |
| 5,074,690 | 12/1991 | Del Signore, II et al. | 400/322 |

FOREIGN PATENT DOCUMENTS

| | | | |
|---|---|---|---|
| 0227778 | 10/1987 | Japan | 400/279 |

*Primary Examiner*—Eugene H. Eickholt

*Attorney, Agent, or Firm*—Fitzpatrick, Cella, Harper & Scinto

[57] ABSTRACT

An apparatus for precisely printing information at a predetermined position on a label on a sheet which has been set at an arbitrary position in a document processing apparatus includes a keyboard for inputting into the document processing apparatus data representing the relative position of print information to be printed with a print head with respect to a print start position and data representing an absolute position of the print start position with respect to a predetermined and fixed reference position on a print plane. The apparatus also includes a central processing unit for controlling the movement of a carriage supporting the print head so that the print head first moves to the absolute position input by said second input means and then moves according to the data representing the relative position of the print information during printing. The invention also relates to a method comprising the steps of inputting the data inputted by the keyboard into the document processing apparatus, and controlling the movement of the carriage as is done by the central processing unit.

24 Claims, 11 Drawing Sheets

OUTPUT METHOD AND APPARATUS

This application is a continuation of application Ser. No. 07/685,640 filed Apr. 16, 1991, now abandoned.

BACKGROUND OF THE INVENTION

1. Field of the Invention

This invention relates to an output method and apparatus which can precisely output information onto a sheet by designating a plurality of desired output positions in a simple operation after presetting the sheet, and to an apparatus for use in the method.

2. Description of Related Background Art

In conventional label printing, the user designates print format information, such as the column width and the number of lines of a label mounted on a sheet, and the number of labels arranged in a row on a sheet, through a keyboard input device, and a document for labels is created according to the format information. When a printing operation is performed, a sheet attached with labels is set in a predetermined position indicated in the format information.

However, in the above prior art, it is required to set a sheet on which labels are mounted right in a predetermined position. Therefore, it is also necessary to set the size and arrangement of the labels mounted on the sheet while making allowance for the slippage due to the formation of the label sheet on which the labels are arranged. Furthermore, although such a process can prevent character information from being printed outside of the label, it is impossible to obtain enough precision to print the character information at an ideal position on the label.

SUMMARY OF THE INVENTION

It is an object of the present invention to overcome the problems of the prior art.

It is another object of the present invention to provide an apparatus and method for accurately positioning character information at any desired position on the labels during printing of the character information on the labels.

It is still another object of the present invention to provide an apparatus and method for printing character information on a plurality of labels on a sheet according to a preset format.

It is still another object of the present invention to provide an apparatus and method for precisely printing information at a predetermined position on a label on a sheet which has been set at an arbitrary position in a document processing apparatus.

According to one aspect, the apparatus which achieves these objectives relates to a control apparatus for use in a document processing apparatus having a movable carriage supporting a print head. The control apparatus comprises first input means for inputting into the document processing apparatus data representing the relative position of print information to be printed with the print head with respect to a print start position. The control apparatus further comprises second input means for inputting into the document processing apparatus an absolute position of the print start position with respect to a predetermined and fixed reference position on a print plane. The control apparatus also comprises recording control means for controlling the movement of the carriage so that the print head first moves to the absolute position input by the second input means and then moves according to the data representing the relative position of the print information during printing.

The first input means can comprise a keyboard, the second input means can comprise a central processing unit and the keyboard, and the recording control means can comprise the central processing unit.

The document processing apparatus further comprises means for moving the carriage from a home position to the print start position in response to the user inputting instructions for movement of the carriage from the keyboard. The central processing unit determines the absolute position of the print start position by computing the distance the carriage moves from the home position to the print start position in response to the user instructing the carriage to move from the home position to the print start position.

The document processing apparatus also comprises means for moving a sheet having a plurality of labels of substantially identical size arranged in rows and columns thereon. The keyboard is adapted to input data representing the relative position of print information to be printed on the plurality of labels on the sheet including:

data representing the top, left margin of a first label, the right margin of the first label, the bottom, left margin of the first label, the left margin of a second label adjacent to and to the right of the first label, and the top, left margin of a third label adjacent to and beneath the first label;

data representing the distance the sheet moving means moves the sheet prior to printing; and data representing tabs and decimal tabs defining the position on each label at which printing will start. The recording control means controls the movement of the carriage to move the print head during printing on the basis of the data input by the keyboard.

The control apparatus further comprises means for displaying the data representing the relative position of print information to be printed with the print head with respect to a print start position, and a memory for storing the data representing the relative position of print information to be printed with the print head with respect to a print start position.

The document processing apparatus further comprises means for moving a sheet having a plurality of labels thereon and on which the print head is adapted to print. In this embodiment, the control apparatus further comprises a memory for storing the number of labels on the sheet and the central processing unit counts the number of labels on which printing occurs, determines when printing has occurred on all the labels on the sheet, and instructs the sheet moving means to move the label sheet in response to determining that printing has occurred on all of the labels on the sheet.

According to another aspect, the present invention which achieves these objectives relates to a control apparatus for use in a document processing apparatus. The control apparatus comprises means for inputting into the document processing apparatus format data of print information to be printed on a plurality of labels on a label sheet, means for detecting the position of a label sheet having a plurality of labels thereon inserted into the document processing apparatus, means for displaying a preset mark representing a predetermined reference position of the label sheet and for displaying a mark representing the position of the label sheet detected by the detecting means, and means for correcting the inputted format data in accordance with a comparison between the preset mark and the mark representing the position of the label sheet detected by the detecting means.

In one embodiment, the inputting means and the correcting means comprise a keyboard, and the detecting means comprises a photosensor. In another embodiment, the document processing apparatus further comprises a sheet presser mechanism for positioning the sheet, and the detecting means comprises means for detecting the position of the sheet presser mechanism.

According to still another aspect, the invention which achieves these objectives relates to a method for controlling a document processing apparatus having a movable carriage supporting a print head. The method comprises the steps of inputting into the document processing apparatus data representing the relative position of print information to be printed with the print head with respect to a print start position, inputting into the document processing apparatus data representing an absolute position of the print start position with respect to a predetermined and fixed reference position on a print plane, and controlling the movement of the carriage so that the print head first moves to the absolute position input in the absolute position input step and then moves according to the data representing the relative position of the print information during printing.

The controlling step comprises the steps of inputting into the document processing apparatus instructions for moving the carriage from a home position to the absolute position of the print start position, moving the carriage from the home position to the absolute position of the print start position, and computing the distance the carriage moves from the home position to the absolute position of the print start position, thereby determining the absolute position of the print start position.

The method further comprises the step of moving a sheet prior to printing thereon, the sheet having a plurality of labels of substantially identical size arranged in rows and columns thereon. In this embodiment, the relative position data inputting step further comprises the steps of:

inputting into the document processing apparatus data representing the top, left margin of a first label, the right margin of the first label, the bottom, left margin of the first label, the left margin of a second label adjacent to and to the right of the first label, and the top, left margin of a third label adjacent to and beneath the first label;

inputting into the document processing apparatus data representing the distance the sheet moves in the sheet moving step prior to printing; and inputting into the document processing apparatus data representing tabs and decimal tabs defining the position on each label at which printing will start.

In this embodiment, the controlling step comprises the step of controlling the movement of the carriage to move the print head during printing on the basis of the data input in the relative position data inputting step.

The method also comprises the step of computing the margins of labels other than the first label from the absolute position of the print start position and the inputted data representing the top, left margin of a first label, the right margin of the first label, the bottom, left margin of the first label, the left margin of a second label adjacent to and to the right of the first label, and the top, left margin of a third label adjacent to and beneath the first label.

In addition, the method further comprises the steps of storing the number of labels on the sheet in a memory, counting the number of labels on which printing occurs, determining when printing has occurred on all of the labels of the sheet, and moving the label sheet after the counting and determining steps.

According to still another aspect, the present invention relates to a method for controlling a document processing apparatus having a movable carriage supporting a print head for printing on a plurality of labels on a label sheet. The method comprises the steps of setting the label sheet at an arbitrary position in the document processing apparatus, and designating the position at which printing will start on a label of the label sheet after the label sheet is set in the setting step.

The designating step can comprise the relative and absolute position inputting steps and the controlling step discussed above. In addition, the controlling step can comprise the inputting, moving, and computing steps noted above, and the relative position inputting step can comprise the margin, distance, and tab inputting steps discussed above.

In addition, the method further comprises the step of computing the margins of labels other than the first label, from the absolute position of the print start position and the input ted data representing the top, left margin of a first label, the right margin of the first label, the bottom, left margin of the first label, the left margin of a second label adjacent to and to the right of the first label, and the top, left margin of a third label adjacent to and beneath the first label.

In an alternative embodiment the designating step comprises the steps of inputting into the document processing apparatus format data of print information to be printed on the plurality of labels, detecting the position of the label sheet inserted into the document processing apparatus, displaying a preset mark representing a predetermined reference position of the label sheet, displaying a mark representing the position of the label sheet detected in the detecting step, comparing the preset mark and the mark representing the position of the label sheet detected in the detecting step, and correcting the inputted format data in accordance with the comparison made in the comparison step.

DETAILED DESCRIPTION OF THE PREFERRED EMBODIMENTS

An embodiment of this invention will now be described with reference to the drawings.

Figure 1:
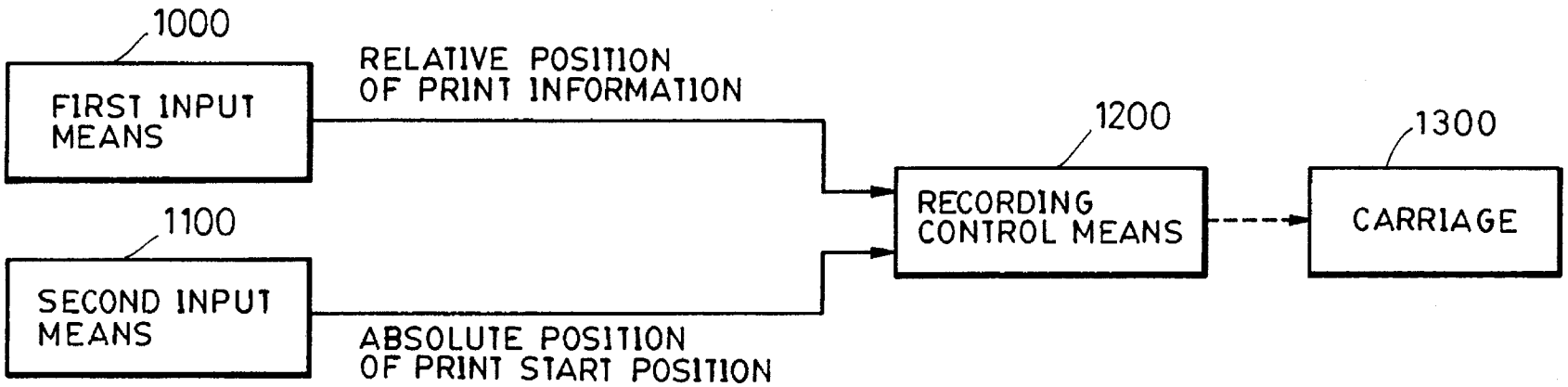
FIG. 1 is a block diagram showing a basic arrangement of an embodiment of this invention.

FIG. 1 shows a basic arrangement of the embodiment of this invention.

A document processing apparatus of this embodiment can perform label printing.

A relative position of label print information with respect to a print start position is input from a first input means 1000.

An absolute position of the print start position with respect to a predetermined and fixed reference position on a print plane is input from a second input means 1100.

A recording control means 1200 moves a carriage 1300 with a recording head mounted thereon to the absolute position input from the second input means 1100, and then, moves the carriage 1300 for a printing operation according to the relative position input from the first input means 1000.

Figure 2:
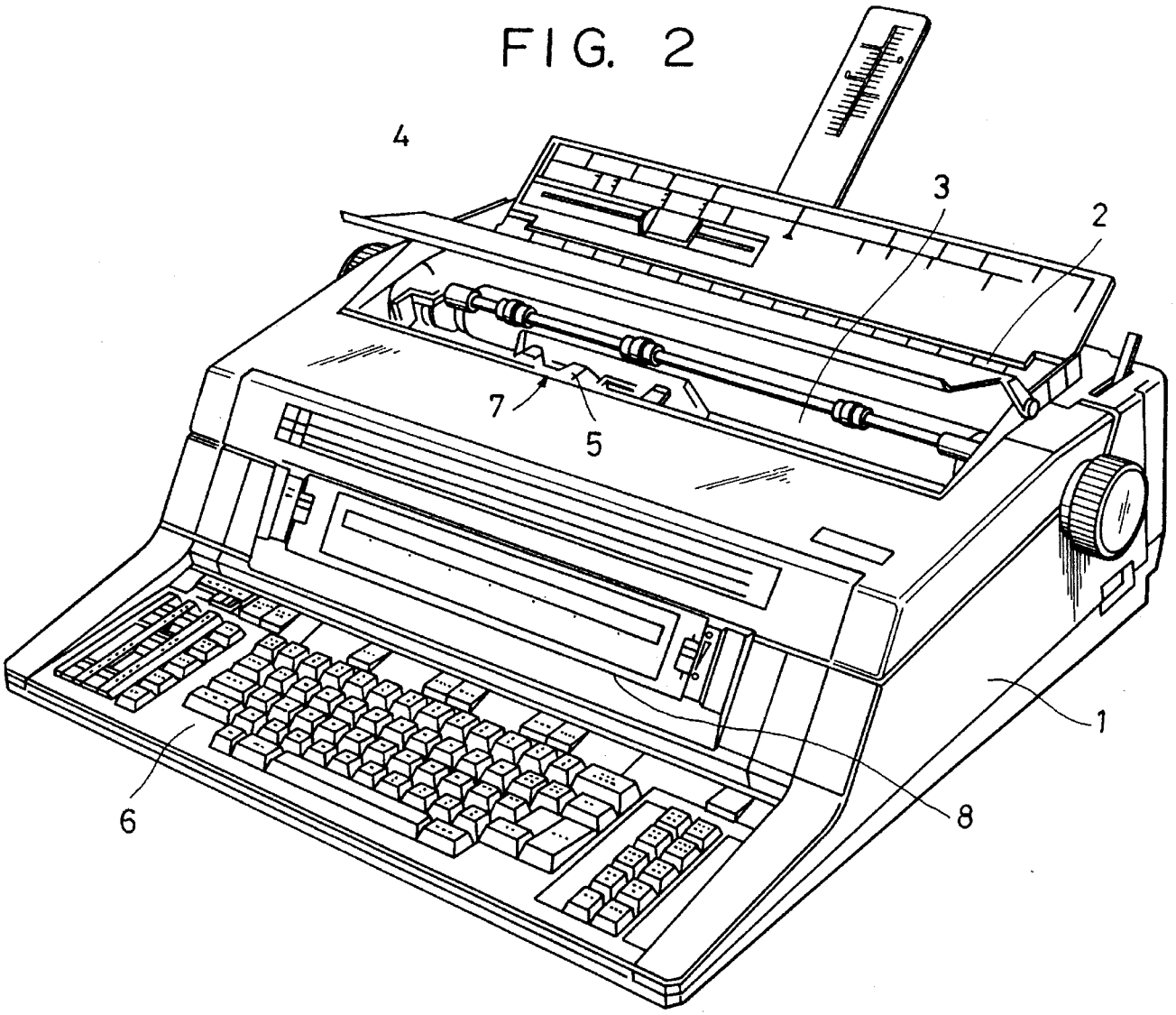
FIG. 2 is an external perspective view of the embodiment of this invention.

Previous to describing this invention, an electronic typewriter, to which this invention is applied, will be schematically described with reference to FIG. 2. FIG. 2 is an external perspective view of the electronic typewriter.

Referring to FIG. 2, document creation information and directions related to character processing and print processing are input from a keyboard input device 6.

A display device 8 displays the document information which is being created.

Figure 3:
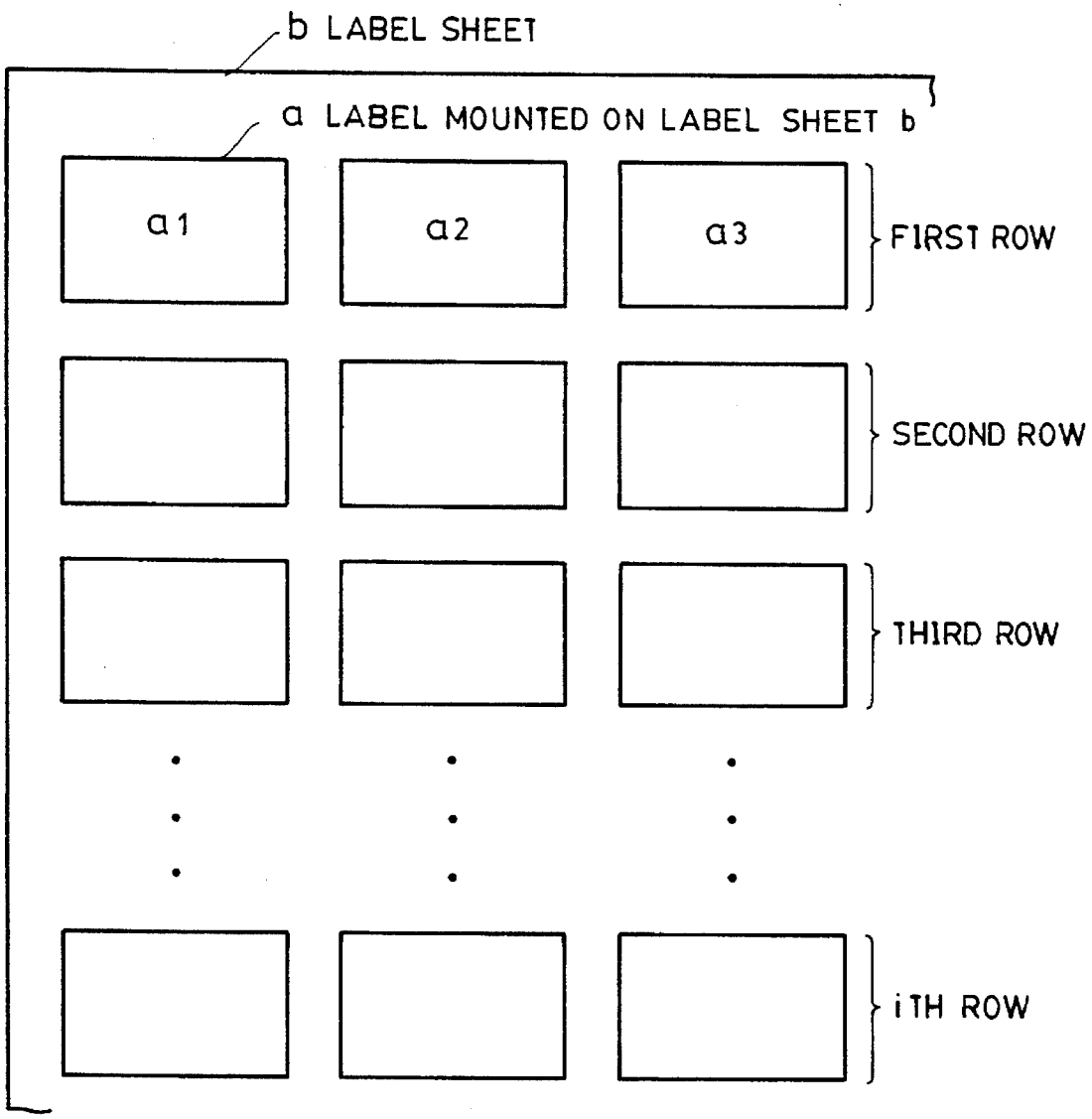
FIG. 3 is a plan view showing the appearance of a label sheet in the embodiment of this invention.

In a printing operation, the user inserts a label sheet b on which a plurality of labels a1, a2, a3, . . . are mounted, which are arranged in a predetermined manner shown in FIG. 3, into a sheet insertion path 2, winds the sheet b on a platen 3, and positions the sheet b near a carriage 7. In the embodiment shown in FIG. 3, the labels are arranged in a plurality of rows.

Figure 4:
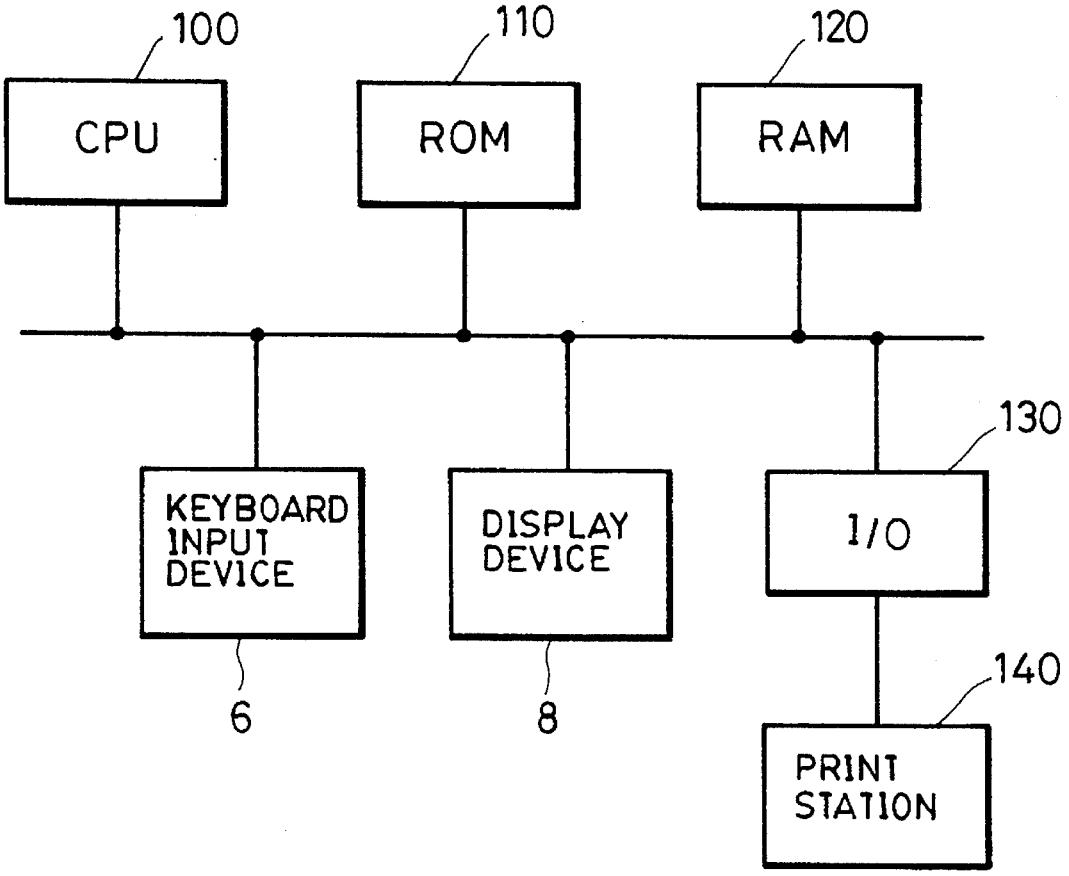
FIG. 4 is a block diagram showing a specific circuit arrangement of the embodiment of this invention.

FIG. 4 shows a circuit arrangement of the embodiment of this invention.

Referring to FIG. 4, a central processing unit (CPU) 100, a read-only memory (ROM) 110, a random-access memory (RAM) 120, the keyboard input device 6, the display device 8 and an input/output interface (I/O) 130 are connected to a bus. The CPU 100 controls not only the entire apparatus, but also controls printing operations according to this invention.

Figure 8:
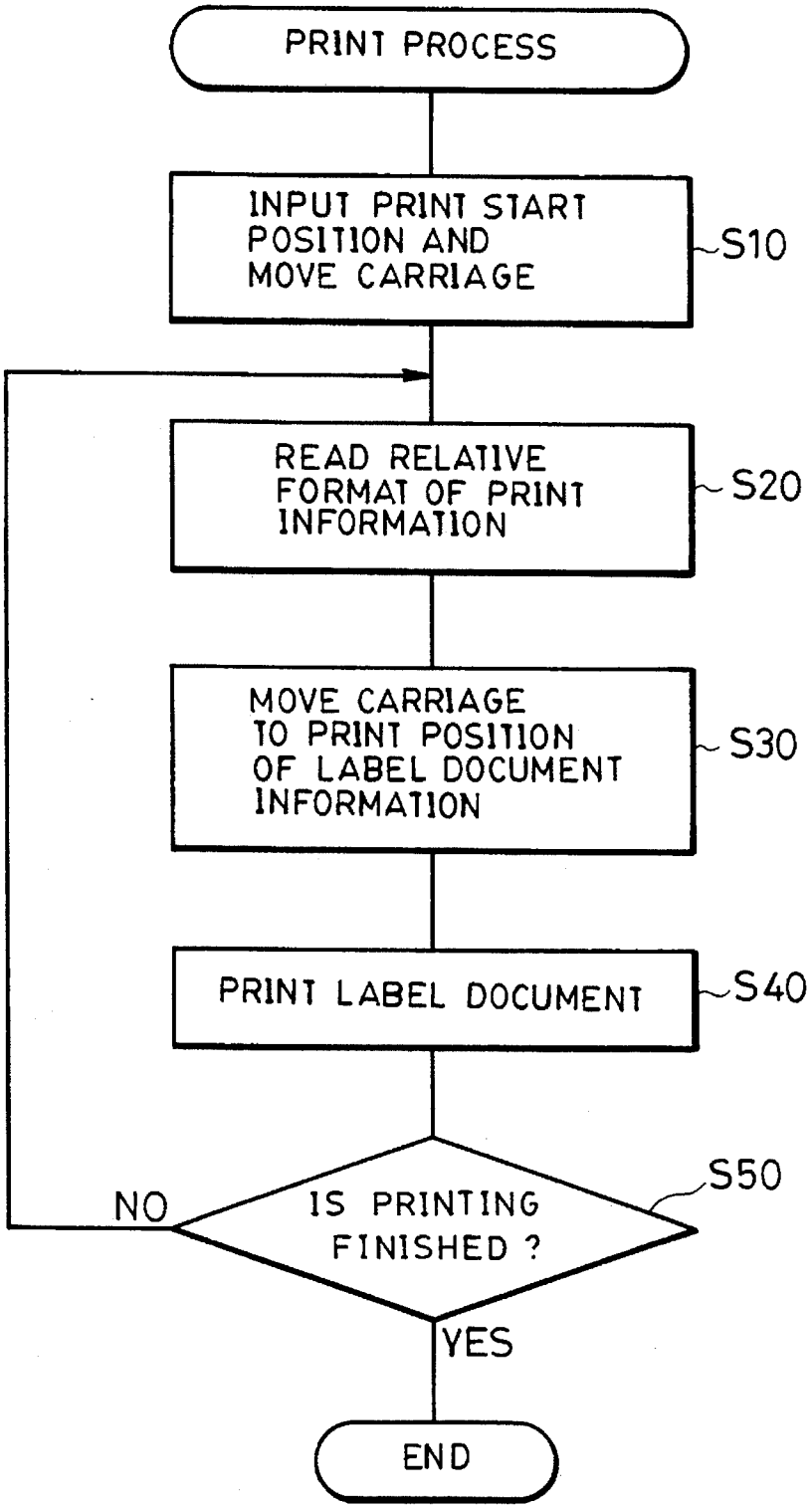
FIG. 8 is a flow chart showing control procedures for label printing by a CPU 100 shown in FIG. 4.

The ROM 110 stores procedures for creating and processing a label document to be printed onto labels and print processing procedures shown in FIG. 8 according to this invention. These processing procedures, written in programming language which the CPU 100 can execute, are selectively read and executed by the CPU 100.

The RAM 120 temporarily stores a created document and format information therein, and stores various kinds of data used for processing by the CPU 100.

The I/O 130 is connected to a print station 140, and transfers character information to be printed and movement directions from the CPU 100 to the print station 140.

Figure 5:
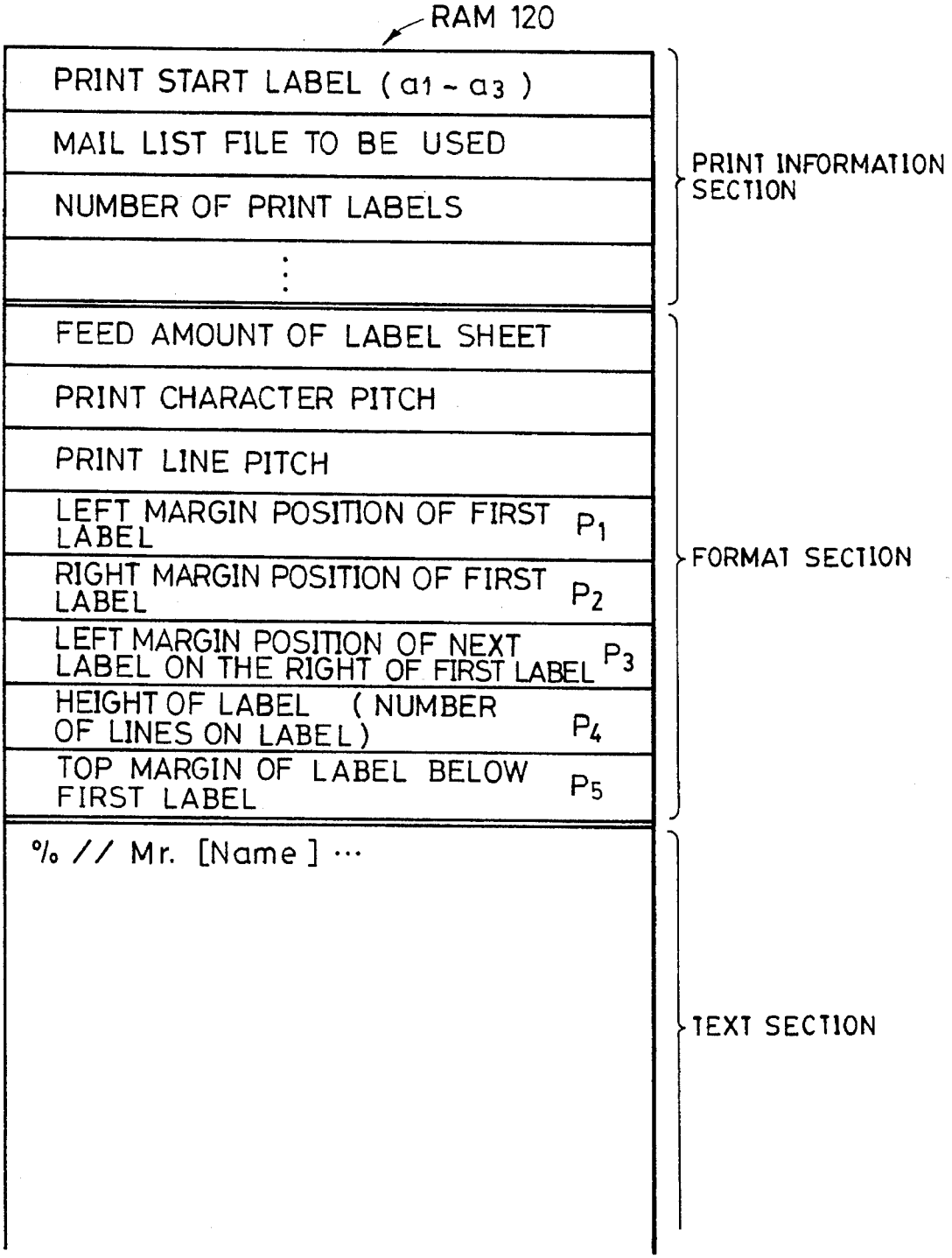
FIG. 5 is a schematic explanatory view of a memory region of a RAM 120 for storing information related to a label document in the embodiment of this invention.

Storage regions for storing data representing a label document to be printed and format information thereof are prepared in the RAM 120 as shown in FIG. 5. When the document is being created and when a printing operation starts, the format information input from the keyboard input device 6 is stored in the storage regions by the CPU 100.

The processing procedures of the user to create a label document will now be described.

Figure 6:
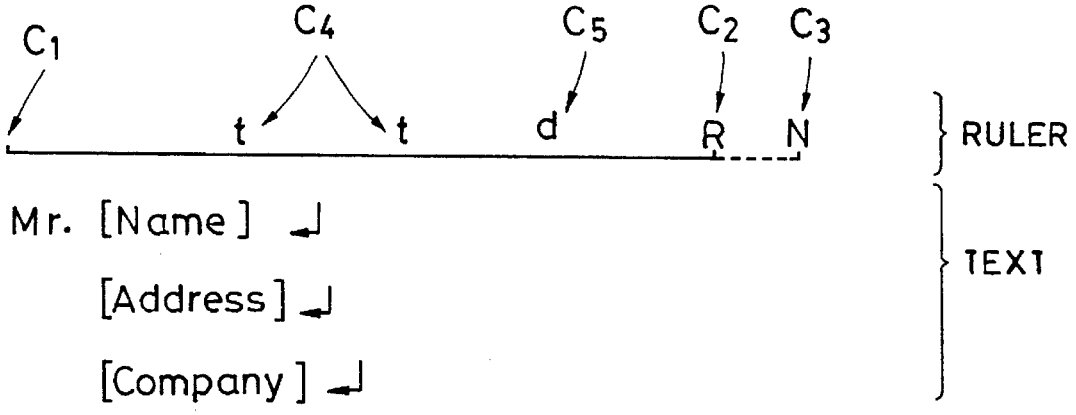
FIG. 6 is a schematic view of an example of the label document created in the embodiment of this invention.

FIG. 6 shows the ruler and text section displayed by the display device 8 before information to be printed on a label is inputted via the keyboard input device 6. It should be noted that the display device 8 displays all the material shown in FIG. 6 except the reference symbols C1–C5, the arrows extending therefrom, and the terms "RULER" and "TEXT", which are merely shown in FIG. 6 for the purposes of explanation.

Referring to FIG. 6, displayed on a display screen of the display device 8 (when inputting information to be printed on a label) are format information and the text to be printed. The format information is displayed in a RULER section of the display screen above a horizontal line, and the text information is displayed in the TEXT section below the horizontal line. In the TEXT section, the word "Name", "Address", and "Company", are displayed in brackets, to prompt the user to cause the display of the name of the addressee, the address of the addressee, and the name of the company of the addressee in the appropriate places by typing in a key word which will retrieve the name of the addressee, the address of the addressee, and the company of the addressee from a mail list file stored in the document processing apparatus. In the RULER section, two tabs "t", a decimal tab "d", a right margin "R", and a left margin "N" of the next label are displayed. The location of the tabs and margins can be changed by the user by inputting the appropriate commands from the keyboard input device 6. C1 corresponds to the left margin of a first label and denotes the left margin position shown on a ruler. C2 similarly denotes the right margin position of the first label. C3 corresponds to the left margin of the next label on the right of the first label, and C4 and C5 denote a tab and a decimal tab, respectively.

Figure 7:
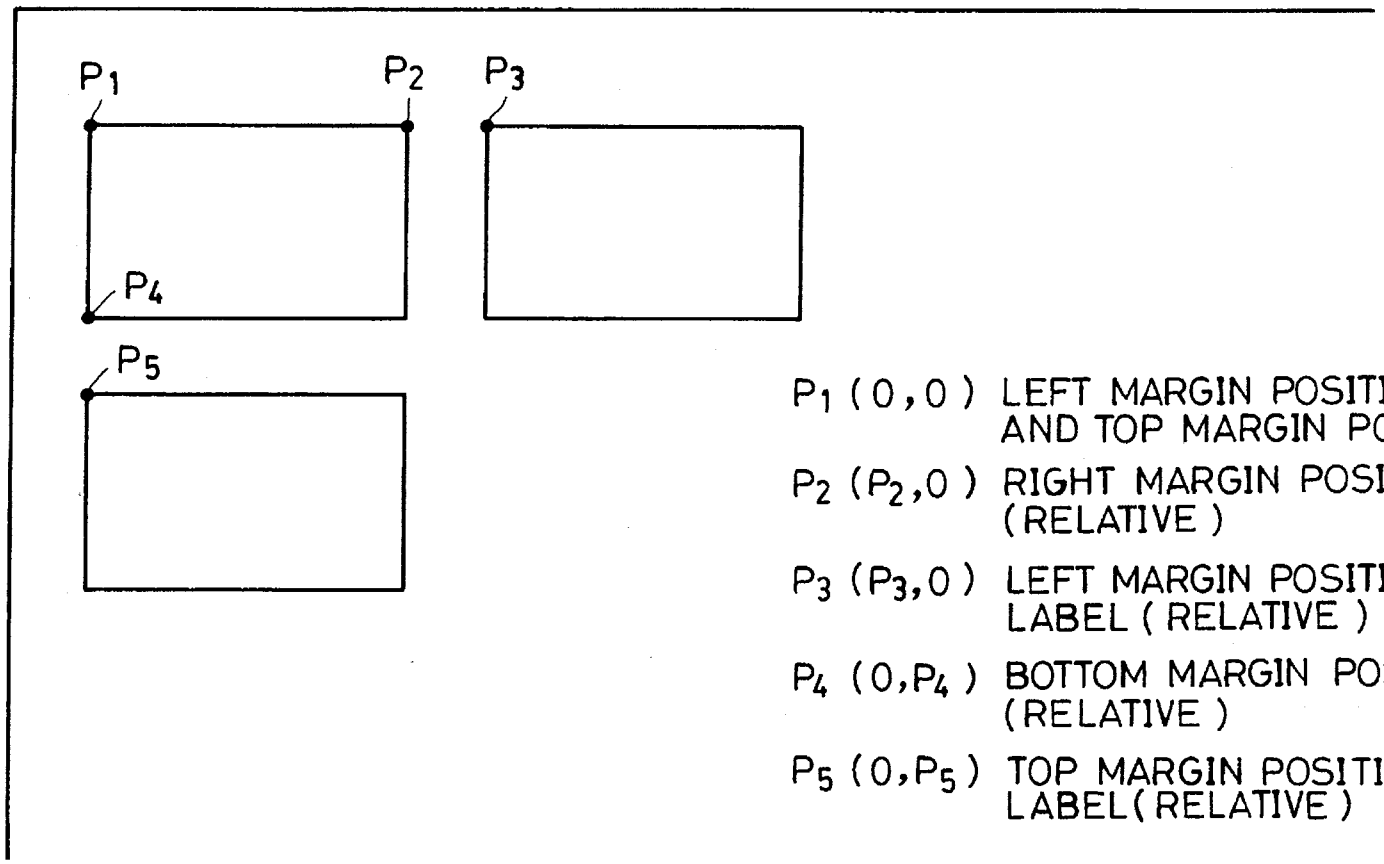
FIG. 7 is a schematic explanatory top view showing print start positions of three labels, respectively, in the embodiment of this invention.

When the label document is created, the user inputs and creates a format for a label corresponding to a label mounted on the sheet from the keyboard input device 6. As shown in FIG. 7, this format information includes designating points P1, P2, P3, P4, and P5. The points P1 and P2 designate the margin width of the label document, and the points P2 and P3 designate the lateral distance between the labels. Furthermore, the points P1 and P4 designate the height of the label (the number of lines in one label is regarded as one page), and the points P4 and P5 designate the vertical distance between the labels. In addition, other format information, such as the feed amount of the sheet before printing, information on tabs and decimal tabs to show the start position of information printed on a label defined between the points P1 and P2, the character pitch and the line pitch when the document is created, is also input from the keyboard input device 6.

All of this format information is stored in a format section of the RAM 120, as shown in FIG. 5. In addition, the RAM 120 stores print information such as the number of print labels, the mail list file to be used to generate the text of the print information, and the label on which printing will start in a print information section of the RAM 120, as also shown in FIG. 5. Finally, the text section of the RAM 120 stores the text to be labelled.

In this invention, the point P1 is regarded as an origin (0, 0) of line 0/column 0 on relative coordinate axes, that is, a print start position, and the other points P2, P3, P4 and P5 are regarded as relative positions with respect to P1.

Therefore, the keyboard input device 6 which inputs the position of the document information to be printed on the labels functions as a first input means. The position of the document information to be printed on the labels is shown by P1 and P2, and designated by the user, in a ruler on a document display screen of the display device 8 together with the tabs and decimal tabs.

The document information to be printed is input as shown in FIG. 6. Referring to FIG. 6, [Name], [Address], and [Company] are commands the user inputs (orders) to extract names and addresses from a data base called a mail list file (for example, an address list) stored in the document processing apparatus by key word retrieval. The extracted data is used as print data. The format and the document information thus created are stored in the RAM 120 by the CPU 100, as noted above.

Figure 9:
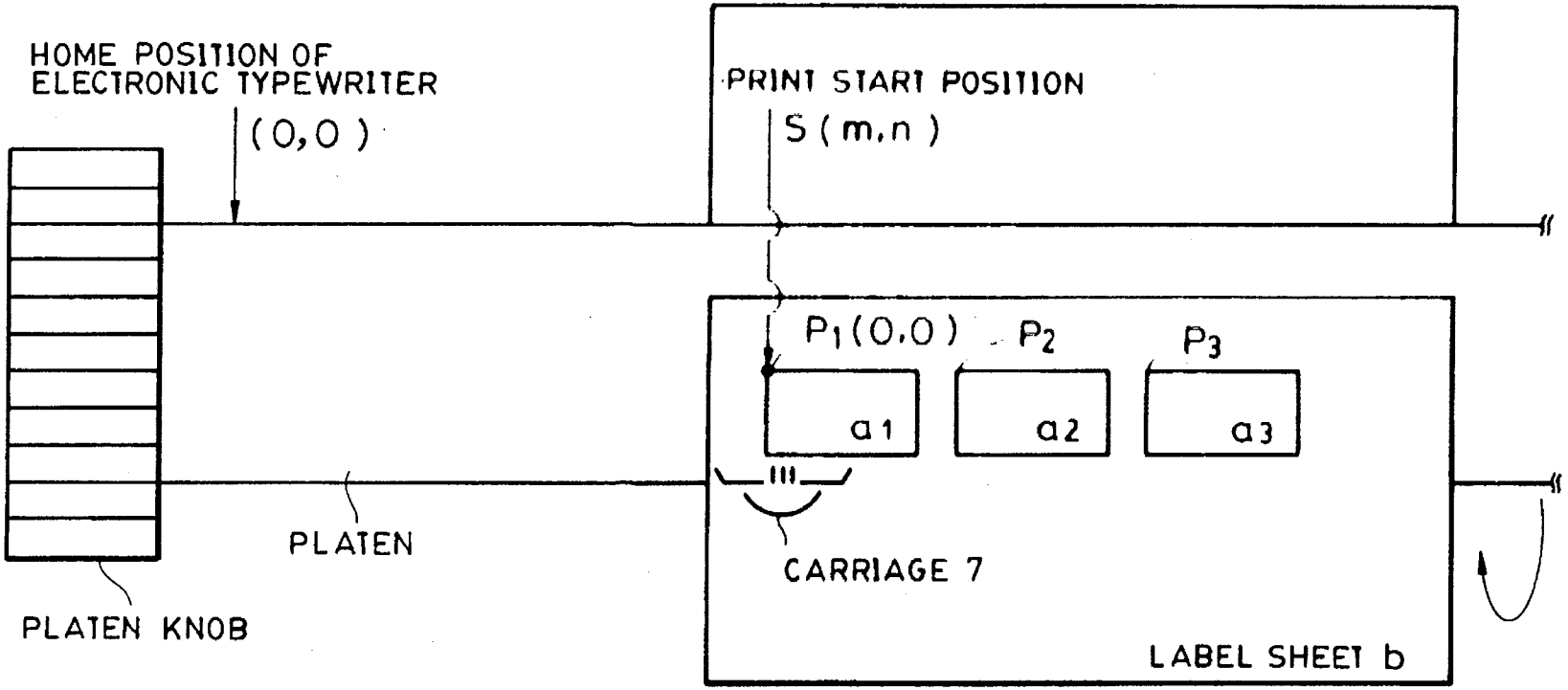
FIG. 9 is an explanatory plan view of the procedures for designating the print start position of a carriage in the embodiment of this invention.

The label printing operation will now be described with reference to a flow chart shown in FIG. 8. When the created document is printed, the origin P1 of the format is (0, 0). To print, the user inserts a label sheet into the sheet insertion path 2, and winds the label sheet on the platen 3. The setting position is arbitrary. Then, the user moves the carriage 7 of the electronic typewriter onto a label a1 by operating direction keys on the keyboard input device 6 so as to make the position of the carriage 7 coincide with the position corresponding to the point P1 (see FIG. 9).

In order to determine the position of the carriage 7 on the platen, more specifically, the distance the carriage 7 has moved from the home position thereof, the CPU 100 measures the number of times the direction keys are pressed down or the time during which the direction keys are pressed down, converts the measured time into the above distance, and determines a print start position S(m, n) as an absolute position (Step S10). At this time, the CPU 100 which determines the position of the carriage 7 functions as a second input means.

In response to a command from the user to start a printing operation, the CPU 100 reads the print start positions of the label documents stored in the RAM 120. In this embodiment, these positions are obtained by taking account of the points P1 (0, 0) and P2 (P2, 0) plus S (m, n) as the left and right margins, respectively. However, each point in the format section is not changed, and is always a relative position with respect to P1 (0, 0).

When the first line of the label document is printed on the label a1, the left margin is P1+S and the right margin is P2+S. In the case of a label a2, the left margin is P2+(P3−P2)+ S and the right margin is P3+(P2−P1)+S. Thus, the margin position (the print start position of a label) is found by the calculation of the CPU 100 and the carriage 7 is moved to the print start position (Steps S20 to S30).

After moving the carriage 7 to the tab position designated according to the format stored in the RAM 120, the label document stored in the RAM 120 is printed.

It is also possible for the CPU 100 to regard the first line of the labels a1, a2 and a3 as the first line of the whole label sheet, to regard the space between the left margin of the label a1 and the right margin of the label a3 as a print margin, to calculate the positions of the label documents respectively, and to print the label documents.

When the first line is printed on the label, the CPU 100 changes the print start position S (m, n) to S (m, n+1), and prints subsequent lines to P4+S by the same process as above.

Every time the printing for a label is completed, the CPU 100 counts the number of printed labels. When it is determined by the CPU 100 that the number of printed labels has reached the total number of labels on one label sheet (the product of the number of labels in a column by the number of labels in a row written in the format section of the RAM 120), the CPU 100 determines that the label printing for one label sheet is completed, ejects the label sheet and completes the control procedures. After that, the user has only to replace a label sheet and designate one point in the label sheet as a print start position, and the CPU 100 continuously executes printing operations in the same manner as above. Therefore, the CPU 100 in designating the above printing operations functions as a recording control means.

There are embodiments other than this embodiment.

Figure 10:
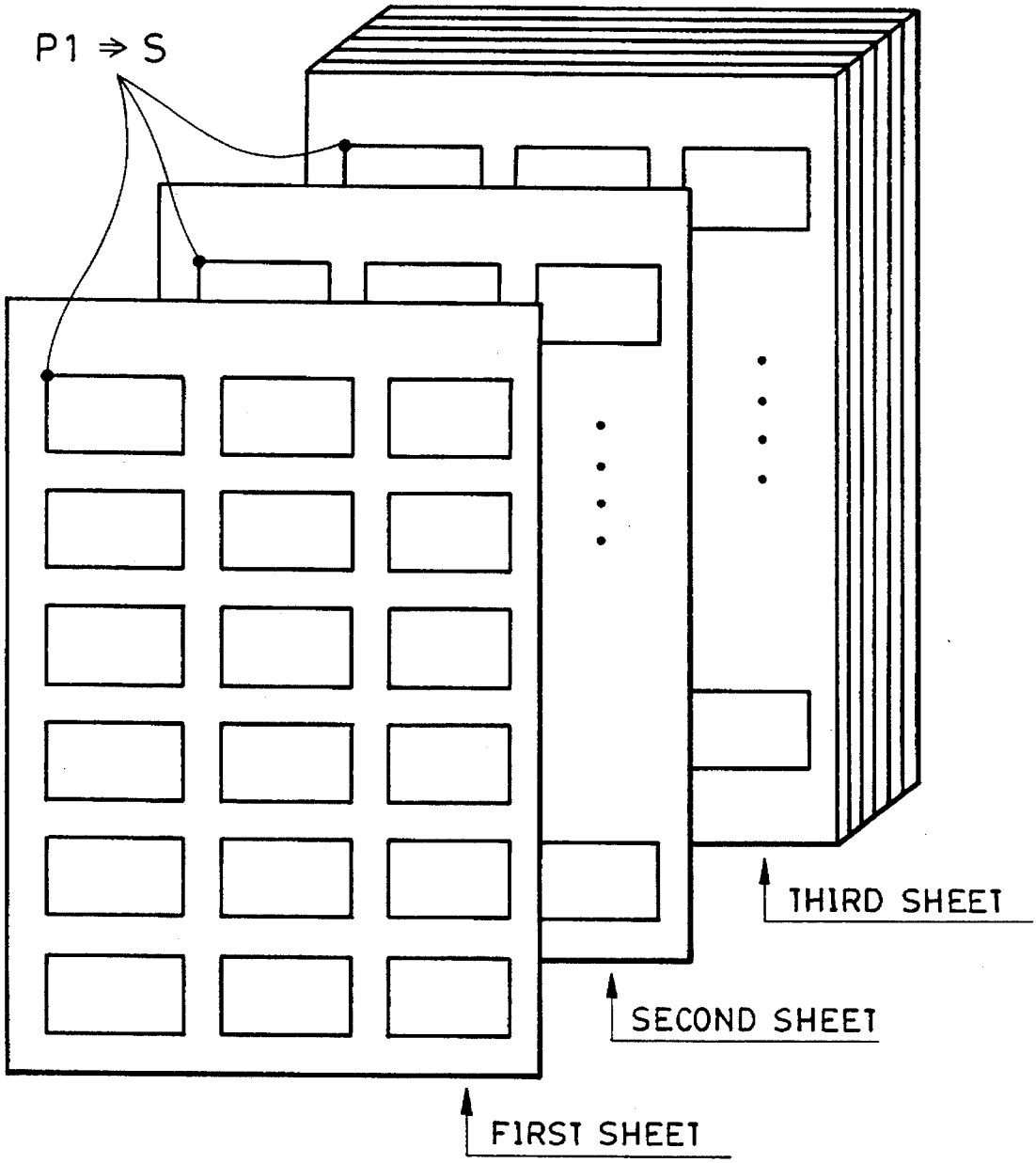
FIG. 10 is an explanatory perspective view of the printing of a plurality of label sheets in the embodiment of this invention.
Figure 11:
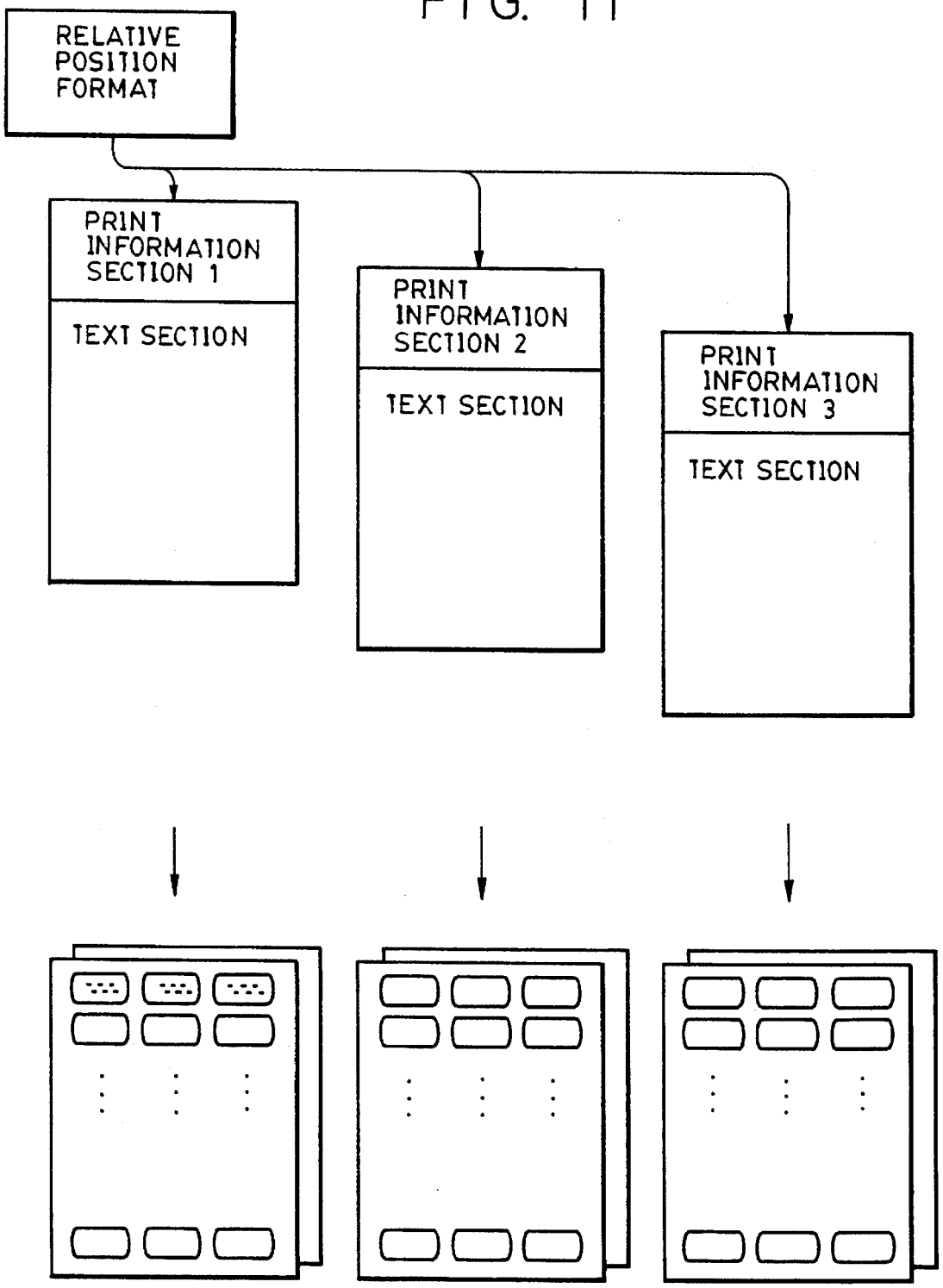
FIG. 11 is a schematic view of the contents of a storage region of the apparatus for storing print information when a plurality of kinds of label documents are printed in a common format in the embodiment of this invention.

1) Although the label document is printed on one label sheet in this embodiment, if the printing on a plurality of label sheets is carried out as shown in FIG. 10, it is preferable to use the format of the first label sheet for subsequent label sheets in common. In this case, the format section and the text section in the RAM 120 are prepared for each label sheet. As a result, it is necessary to prepare only one region as a format section as shown in FIG. 11, thereby saving the memory capacity.
2) Although the electronic typewriter is described as an example in this embodiment, this invention can be applied to other apparatuses capable of processing documents, such as a word processor and a personal computer.
3) Although the print start position is designated by the movement of the carriage in this embodiment, the following methods of designating the print start position may be used.
   a) A photosensor for detecting the positions of both ends of a label sheet is made movable in a main scanning direction and a print start position of the label sheet is detected by detecting changes in the outputs from the photosensor.
   b) A sheet presser mechanism for putting both ends of the label sheet in order is made slidable in the main scanning direction, and the print start position is detected based on the position of the sheet presser mechanism.
   c) After the position of the label sheet is automatically detected by either of the above methods a) or b), the automatically detected position of the label sheet is displayed by a mark in the ruler section of the display of the labels of the display device 8. The user is informed of the distance between the position where the label sheet should be set and the actual set position of the label sheet by comparing the displayed mark and a position mark of the label sheet preset on a display screen of the display device 8, and the user may correct the set format information by moving a cursor or inputting numerals.
   d) It is also possible to mount graduations, which allows the position of the label sheet wound on the platen to be visually recognized, on a sheet presser roller or the like and to input the position of the label sheet in numerals from the keyboard input device 6.
   e) In the case of a document processing apparatus to which an automatic sheet feeding device is attached, it is possible to confirm the attachment of the automatic sheet feeding device and to automatically set the print start position of the first label sheet which is determined by the setting position of the automatic sheet feeding device.

As described above, according to this invention, a label sheet is not set in a preset position, and the print start position of a label sheet is designated after setting the label sheet. Therefore, it is possible not only to set the label sheet in an arbitrary position but also to precisely print information at a predetermined position on the label without any setting errors of the label sheet.

The individual components represented by the blocks shown in FIGS. 1 and 4, and the components of the typewriter shown in FIG. 2 are well known in the document processing art and their specific construction and operation is not critical of the invention or the best mode for carrying out the invention. Moreover, the steps illustrated in FIG. 8 can be easily programmed into well known central processing units by persons of ordinary skill in the art and since such programming per se is not part of the invention no further description thereof is deemed necessary.

What is claimed is:

1. An apparatus for controlling a printer to output a plurality of documents on a display of labels, comprising:

first input means for inputting the absolute position of a predetermined fixed standard position for printing a plurality of labels after setting a label sheet having the plurality of labels in the printer;

second input means for inputting the size of a label and the position of the next label to determine the relative position of print information to be printed on the plurality of labels with respect to the absolute position of the fixed standard position;

first guide means for controlling the position of the printer for outputting a document for a first label on the basis of the absolute position input by said first input means; and second guide means for controlling the position of the printer for outputting a document for a second label on the basis of the relative position input by said second input means.

2. An output apparatus according to claim 1, further comprising a keyboard for inputting the relative position of the print information.

3. An output apparatus according to claim 1, wherein said first input means determines the absolute position of the predetermined fixed standard position by detecting the distance a carriage of the printer moves from a home position.

4. An output apparatus according to claim 1, further comprising a photosensor, wherein said first input means determines the absolute position by detecting a change in the output of said photosensor.

5. An output apparatus according to claim 1, wherein the relative position is a left margin position of a label, the right margin position of the label, the left margin position of a label adjacent to and to the right of the label, the height of the label, and a top margin position beneath the label.

6. An apparatus according to claim 1, further comprising a printer for printing the plurality of documents on the display of labels.

7. An apparatus according to claim 1, further comprising a display device for displaying document information representing the plurality of documents outputted by the printer.

8. The apparatus according to claim 1, further comprising a keyboard having a key, the depression of which instructs said first guide means to move the printer to the absolute position, wherein said first input means measures the number of times said key is depressed or the amount of time during which said key is depressed and computes the absolute position therefrom.

9. A method for controlling a printer to output a document on a plurality of labels, comprising:

a first input step for inputting the absolute position of a predetermined fixed standard position for printing a plurality of labels after setting a label sheet having a plurality of labels in the printer;

a second input step for inputting the size of a label and the position of the next label to determine the relative position of print information to be printed on the plurality of labels with respect to the absolute position of a predetermined fixed standard position;

a first guide step for controlling the position of the printer for outputting a document for a first label on the basis of the absolute position input in said first input step; and a second guide step for controlling the position of the printer for outputting a document for a second label on the basis of the relative position input in said second input step.

10. An output method according to claim 9, further comprising a keyboard for inputting the relative position of print information.

11. An output method according to claim 9, wherein said first input step determines the absolute position of the predetermined fixed standard position by detecting the distance a carriage of the printer moves from a home position.

12. An output method according to claim 9, further comprising a photosensor, wherein said first input step determines the absolute position by detecting a change in the output of said photosensor.

13. An output method according to claim 9, wherein the relative position is a left margin position of a label, the right margin position of the label, the left margin position of a label adjacent to and to the right of the label, the height of the label, and a top margin position beneath the label.

14. The method according to claim 9, further comprising the steps of:

depressing a key on a keyboard to instruct the printer to move to the absolute position; and computing the absolute position by measuring the number of times the key is depressed or the amount of time the key is depressed.

15. A document processing apparatus comprising:

first memory means for storing text information of a document to be printed by a printer on a label or displayed on a display;

second memory means for storing common format information for displaying or printing said document for the label;

third memory means for storing print information relating to the printing of the document on the label;

a keyboard for inputting at least five designating points specifying the common format information stored in said second memory means;

display controlling means for controlling the display to display the text information stored by said first memory means on the basis of the format information stored by said second memory means; and print controlling means for controlling the printer to print the text information stored by said first memory means on the basis of the format information stored by said second memory means and the print information stored by said third memory means.

16. A document processing apparatus according to claim 15, wherein the format information comprises a feed amount of a label sheet, print character pitch, print line pitch, a left margin position of a first label, a right margin position of the first label, a left margin position of a next label on the right of the first label, the height of the first label, and the top margin position of a label below the first label.

17. A document processing apparatus according to claim 15, wherein the print information comprises information on the label at which printing is started, a mail list file, and the number of labels on which the printing occurs.

18. An apparatus according to claim 15, further comprising the printer, said printer printing the text information of the document on a display of labels.

19. An apparatus according to claim 15, further comprising the display, said display comprising a display device for displaying the text information stored by said first memory means.

20. The apparatus according to claim 15, wherein the said keyboard has a key, the depression of which instructs said print controlling means to move the printer to an absolute position, wherein said print controlling means computes the absolute position by measuring the number of times said key is depressed or the amount of time said key is depressed.

21. A method comprising the steps of:

inputting into an output apparatus for guiding a printer to output a plurality of documents on labels, the absolute position of a predetermined fixed standard position for printing a plurality of labels;

inputting into the output apparatus at least five designating points specifying the relative position of print information to be printed on the plurality of labels with respect to the absolute position of the fixed standard position;

controlling the position of the printer for outputting a document for a first label on the basis of the absolute position input in said absolute position input step; and controlling the position of the printer for outputting a document for a second label on the basis of the relative position input in said relative position input step.

22. The method according to claim 21, further comprising the steps of:

depressing a key on a keyboard to instruct the printer to move to the absolute position; and computing the absolute position by measuring the number of times the key is depressed or the amount of time the key is depressed.

23. A document processing method comprising the steps of:

storing text information of a document to be printed by a printer on a label or displayed on a display;

inputting at least five designating points specifying common format information for displaying or printing the document on the label;

storing the input common format information for displaying or printing the document on the label;

storing print information relating to the print of the document on the lable;

controlling the display to display the text information stored by said text information storing step on the basis of the format information stored by said common format information storing step; and controlling the printer to print the text information stored by said text information storing step on the basis of the format information stored by said common format information storing step and the print information stored by said print information storing step.

24. The method according to claim 23, wherein said controlling step comprises the steps of:

depressing a key on a keyboard to instruct the printer to move to the absolute position; and computing the absolute position by measuring the number of times the key is depressed or the amount of time the key is depressed.

* * * * *

UNITED STATES PATENT AND TRADEMARK OFFICE

CERTIFICATE OF CORRECTION

PATENT NO. : 5,486,055

DATED : January 23, 1996

INVENTOR(S) : HIROTSUGU OKA

It is certified that error appears in the above-indentified patent and that said Letters Patent is hereby corrected as shown below:

COLUMN 4

Line 17, "input ted" should read --inputted--.

COLUMN 10

Line 63, "a mail list file," should be deleted.

COLUMN 11

Line 5, "the said" should read --said--.

COLUMN 12

Line 12, "lable;" should read --label;--.

Signed and Sealed this

Twenty-fifth Day of June, 1996

Bruce Lehman

*Attest:*

BRUCE LEHMAN

*Attesting Officer*

*Commissioner of Patents and Trademarks*